United States Patent [19]

Schönberger et al.

[11] Patent Number: 4,776,371

[45] Date of Patent: Oct. 11, 1988

[54] CIRCULAR LOOM

[75] Inventors: Johann Schönberger, Zipf; Hermann Pichler, Frankenmarkt; Rudolf Wolf, Lenzing; Ewald Romauer, Vöcklabruck; Franz Nussdorfer, Frankenmarkt; Franz Zacek, Vöcklabruck; Franz Födinger, Seewalchen; Karl Kienesberger, Gmunden, all of Austria

[73] Assignee: Lenzing Aktiengesellschaft, Austria

[21] Appl. No.: 71,291

[22] Filed: Jul. 9, 1987

[30] Foreign Application Priority Data

Jul. 14, 1986 [AT] Austria ..... 1906/86

[51] Int. Cl.[4] ..... D03D 37/00

[52] U.S. Cl. ..... 139/13 R

[58] Field of Search ..... 139/13 R, 13 A, 14, 139/15, 16

[56] References Cited

U.S. PATENT DOCUMENTS

| | | | |
|---|---|---|---|
| 1,720,151 | 7/1929 | Sery . | |
| 2,248,282 | 7/1941 | Pelce | 139/13 R |
| 3,347,279 | 10/1967 | Malchair | 139/13 R |
| 4,619,293 | 10/1986 | Huemer | 139/13 R |

FOREIGN PATENT DOCUMENTS

| | | |
|---|---|---|
| 805026 | 5/1951 | Fed. Rep. of Germany . |
| 1535586 | 2/1971 | Fed. Rep. of Germany . |
| 3323141 | 1/1984 | Fed. Rep. of Germany . |

*Primary Examiner*—Henry S. Jaudon

*Attorney, Agent, or Firm*—Ostrolenk, Faber, Gerb & Soffen

[57] ABSTRACT

In a circular loom having a machine frame, a lower and an upper running race arranged in said machine frame for guiding the shuttle, the running rollers of the shuttle are fitted between guiding surfaces of the upper and lower running race. To avoid contacting between the running rollers of the shuttle and the warp threads, the running races have thread guiding grooves crossing the guiding surfaces. The thread guiding grooves, in the running direction of the shuttle, are arranged to be inclined by an acute angle relative to the radial direction laid at the middle axis of the machine.

11 Claims, 3 Drawing Sheets

CIRCULAR LOOM

The invention relates to a circular loom having a machine frame, a lower and an upper circular running race arranged in the machine frame for guiding a shuttle whose running rollers are fitted between guiding surfaces of the upper and lower running races, the running races having thread guiding grooves crossing the guiding surfaces.

A circular loom of this kind is known from DE-B-No. 1 535 586. Therein, the running rollers of a movable part carrying a cut-to-length part of the weft thread are fitted in between comb-like guiding surfaces. These comb-like guiding surfaces allow for an insertion of the warp threads into the thread guiding grooves of these guiding surfaces, so that a contact of the running rollers with the warp threads can be avoided. The thread guiding grooves are radially directed in this known circular loom. In that case it may happen, particularly with fast running circular looms whose shuttles are provided with warp thread guiding bows for a complete opening of the shed that the warp threads do not slide into the thread guiding grooves, but, due to the contact with the circulating shuttle, are deflected from the radial direction such that they remain lying on the raised webs between the thread guiding grooves and thus are rolled over by the running wheels of the shuttle.

It is, furthermore, known (U.S. Pat. No. 1,720,151, DE-C-No. 805 026) to insert the warp threads into thread guiding grooves crossing the guiding surfaces for the running rollers of the shuttle in order to avoid a contact of the warp threads with the running rollers or with a supporting surface of the shuttle, also there the thread guiding grooves being directed radially to the middle axis of the circular loom. These known constructions thus also are not suitable for fast running machines, since with fast running machines the warp threads often do not slide into the thread guiding grooves, but remain lying on the webs between the thread guiding grooves.

The invention aims at avoiding these disadvantages and difficulties and has as its object to provide a circular loom of the initially defined kind, which is suitable for the highest weaving performances, wherein a shuttle with a warp thread guiding bow—for a complete opening of the shed when the shuttle enters the shed—may be used.

According to the invention, this object is achieved in that the thread guiding grooves, in the running direction of the shuttle, are arranged to be inclined by an acute angle (alpha) relative to the radial direction laid at the middle axis of the machine.

Preferably, the thread guiding grooves are arranged so as to be inclined by an angle of at least 1° relative to the radial direction.

A particularly simple insertion or sliding of the warp threads into the thread guiding grooves is preferably ensured in that the webs arranged between the thread guiding grooves have wedge-shaped tapering projections at their ends directed to the center of the shed.

For ensuring that the running wheels of the shuttle roll off without vibrating, suitably the webs located between the thread guiding grooves and carrying the guiding surfaces are wider than the width of the thread guiding grooves, the ratio of the width of a web to the width of a thread guiding groove advantageously being approximately two to one.

Due to the thread guiding grooves it is possible to select also complicated cross-sectional shaped for the running races. Thus, e.g., the guiding surfaces of the running races suitably are designed so as to be inwardly inclined for very high running speeds of the shuttle.

Preferably, the running races are made of a synthetic material, in particular polyoxymethylene or a polyamide, preferably according to the injection moulding technique, transfer moulding technique or by casting, whereby a particularly simple production of the running races is possible.

According to a preferred embodiment, the running races are assembled of portions produced straight at first, which are fitted into a circular-ring-shaped groove of the machine frame and are fastened in this groove.

The invention will be described below in more detail with reference to the drawings in one exemplary embodiment, wherein.

Figure 1:
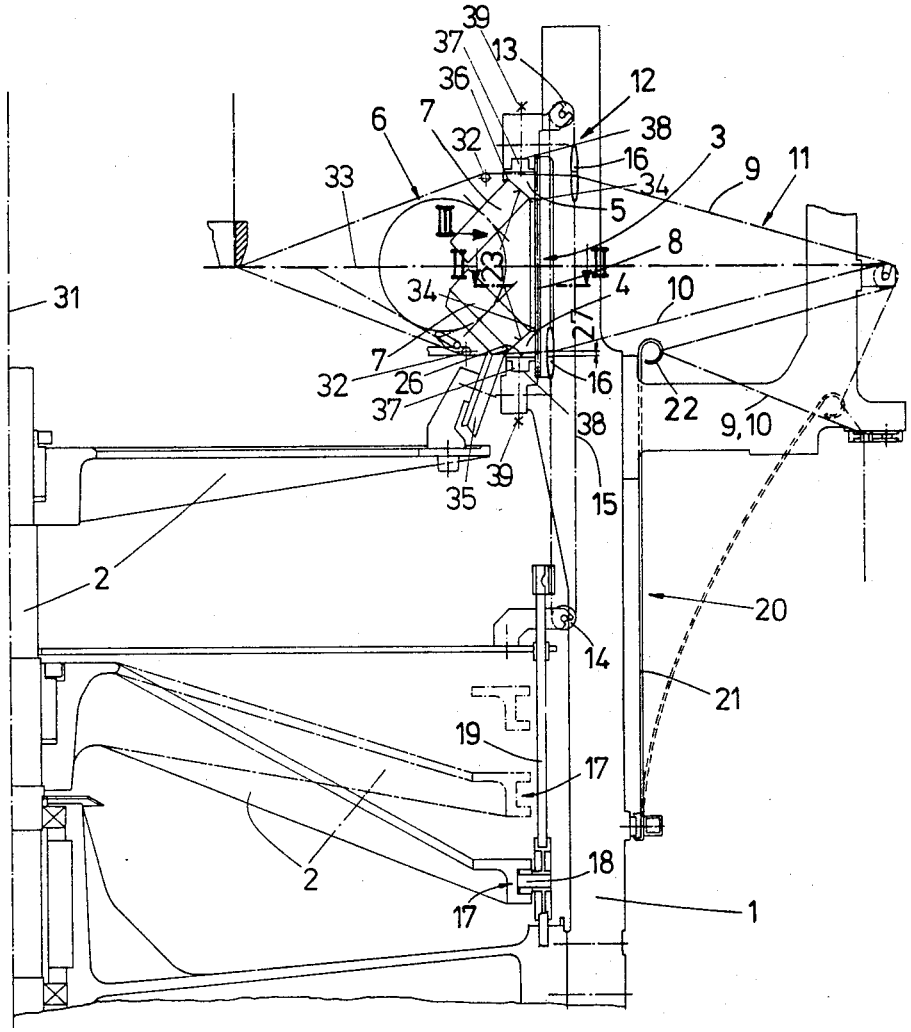
FIG. 1 shows a vertical section laid through the middle axis of a circular loom.

The circular loom comprises a drivable rotor 2 rotatably mounted in a machine frame 1, which rotor is arranged below a stationary circular-cylindrical reed 3. The reed 3 is delimited by a lower and an upper running race 4, 5 of circular ring shape each, along which running races at least one shuttle 6 is guided by means of running rollers 7. Between the running races 4, 5, bars 8 of the reed 3, which bars connect the running races, are provided, between which bars the warp threads 9, 10 are guided.

For forming a shed 11 by the warp threads 9, 10, thread guiding organs 12 concentrically surrounding the reed 3 are provided, which are formed by continuous belts 15 guided over upper and lower deflection pulleys 13, 14, to each of which belts a thread guiding eye 16 is fastened at each side thereof. For actuating the thread guiding organs 12, the rotor 2 has a groove 17 (or tongue) extending wave-like with regard to its height over its periphery, at which groove 17 one of the catch elements 18 is guided. The catch elements 18 are connected with the belts 15 by means of actuating rods 19. At the outer side of the machine frame 1, thread tensioning means 20 are provided for the warp threads 9, 10, which thread tensioning means are formed by spring wires 21 provided at each of their free ends with thread holding means 22.

For accommodating the warp threads 9, 10 forming the shed 11, the running races 4, 5 are provided with thread guiding grooves 24 crossing the guiding surfaces 23 for the running rollers 7. The depth 25 of the thread guiding grooves 24 is selected such that the warp threads 9, 10 do not contact the bottom 26 of the thread guiding grooves 24 when the shed 11 is completely opened (cf. FIG. 1), but get to lie at a slight distance 27 from the same. The webs 28 present between the thread guiding grooves 24 have approximately a width 29 that is twice as large as the width 30 of the thread guiding groove 24. Thus the guiding surfaces 23 are only slightly interrupted by the thread guiding grooves 24.

The thread guiding grooves 24 are aligned with the thread guides formed by the reed 3 and arranged at the circumference of the running races 4, 5, the bars 8 of the reed 3 each being arranged in extension of a web 28 outside of the latter.

Figure 2:
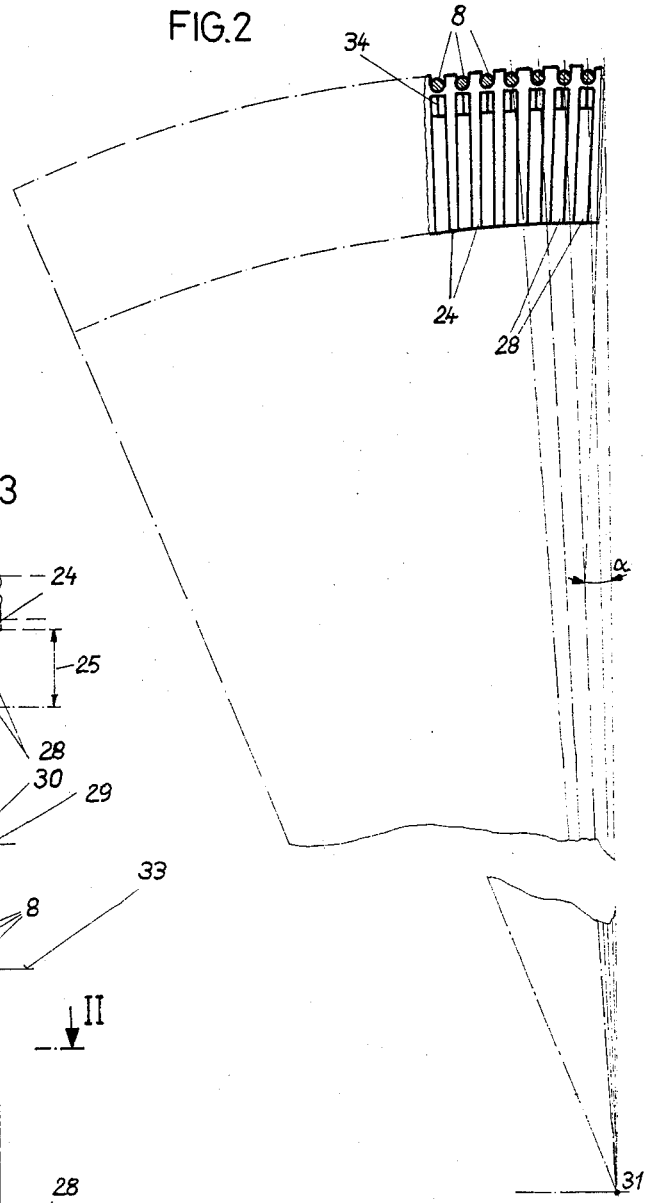
FIG. 2 shows a detail of a section according to line II—II of FIG. 1 on an enlarged scale.
Figure 3:
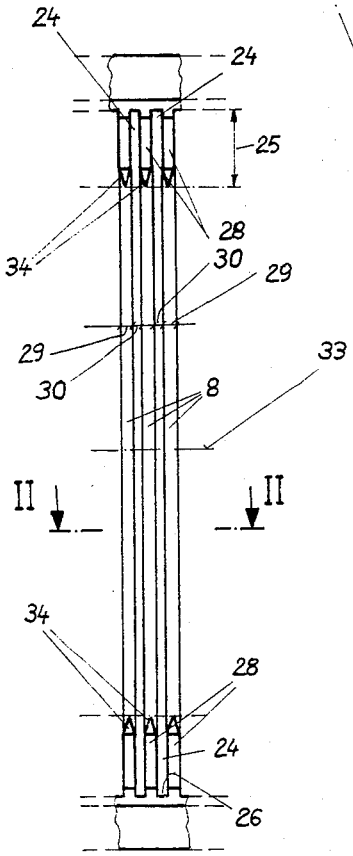
FIG. 3 is a detail of a view in the direction of arrow III of FIG. 1.
Figure 4:
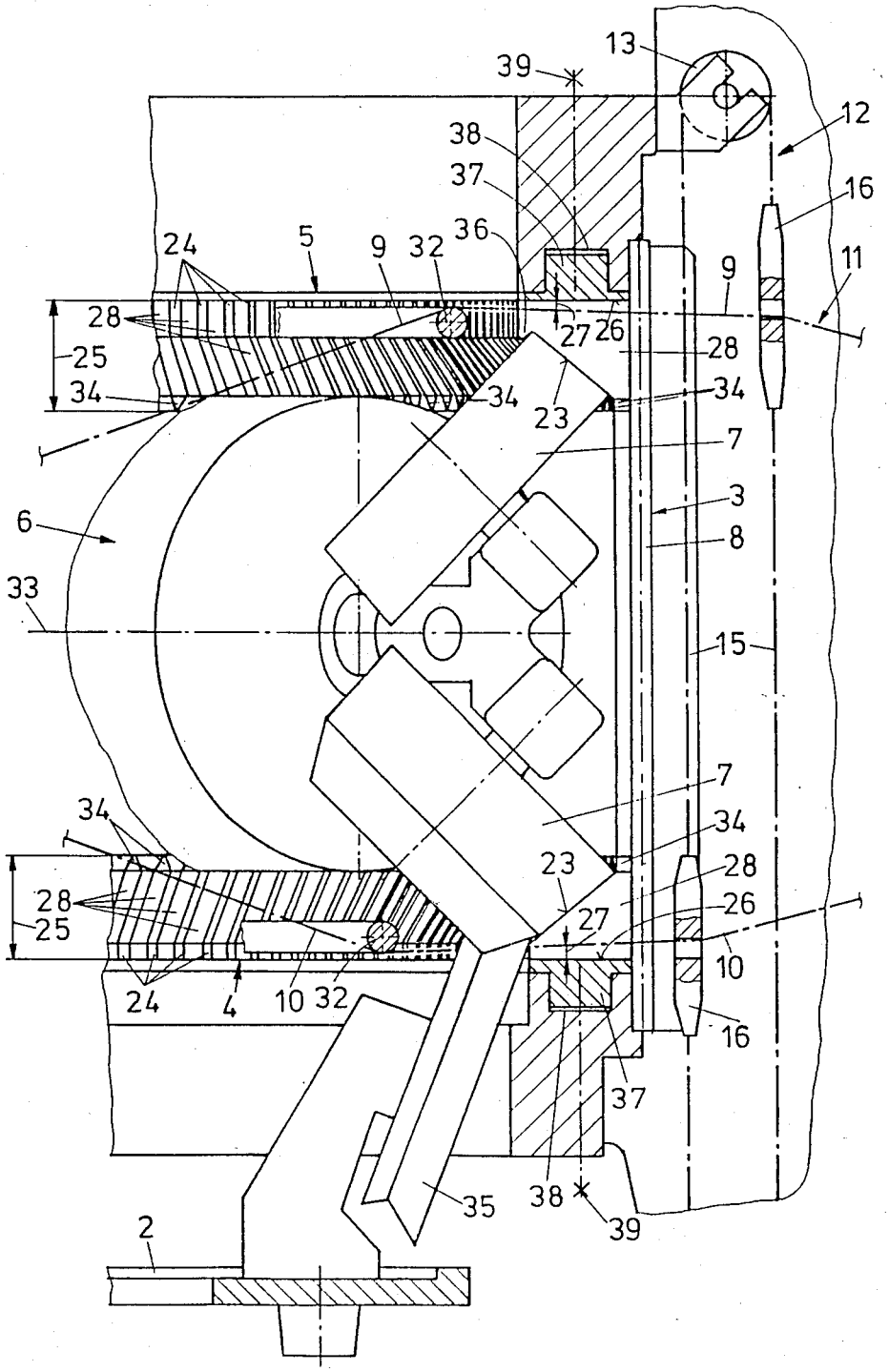
FIG. 4 is a close-up view of the shuttle arrangement of the present invention.

As can be seen from FIG. 2, the thread guiding grooves are not arranged to be exactly radially directed to the middle axis 31 of the machine, but they deviate from the radial direction in the running direction of the shuttle 6 by an acute angle alpha, whereby a faultless sliding-in or insertion of the warp threads 9, 10 into the thread guiding grooves 24 is ensured, which warp threads 9, 10 are straddled open by thread guides arranged on the shuttle 6 and designed as thread guiding bows 32. Insertion of the warp threads 9, 10 is furthermore facilitated in that the webs 28, at their ends directed to the center of the shed 33, have wedge-shaped projections 34. These projections project beyond the guiding surfaces 23 and simultaneously form a support for the running rollers 7 of the shuttle 6. The acute angle alpha, at which the thread guiding grooves 24 are inclinedly arranged relative to the radial direction, preferably is more than 1°.

A substantial advantage of the circular loom according to the invention consists in that the warp threads 9, 10—apart from the drive roller 35 rotatably journaled on the rotor 2 and driving the shuttle 6—only get into contact with machine parts by the thread guiding eyes 16 and the thread guiding bows 32 in the region of the shed, so that one has a free hand as regards the construction of the guiding surfaces 23 of the running races 4, 5. According to the exemplary embodiment illustrated, e.g., the guiding surfaces 23 are arranged to be inwardly inclined and the upper guiding surface 23 is provided with an inner rim 36 supporting the upper running wheels 7 of the shuttle 6 projecting downwardly beyond the guiding surface 23, which inner rim prevents an inward tilting of the shuttle 6 when the latter stands still. The running races 4, 5 suitably are made of synthetic material; they are assembled of portions produced straight at first, wherein the individual portions have a foot 37 each fitted into a circular-ring-shaped groove 38 of the machine frame 1 and fastened in this groove 38, e.g., by means of screws 39.

What we claim is:

1. In a circular loom arranged about a longitudinal axis, and comprising a machine frame, a lower circular running race and an upper circular running race disposed in said machine frame, and a shuttle guided in said upper and said lower circular running races, said shuttle having running rollers and said upper and said lower circular running races having guiding surfaces for said running rollers of said shuttle, and said upper and said lower circular running races having thread guiding grooves disposed in said guiding surfaces for guiding respective threads therein, the improvement comprising that the thread guiding grooves, in the running direction of said shuttle, are inclined at an acute angle relative to a line extending radially from said longitudinal axis of said loom.

2. A circular loom as set forth in claim 1, wherein said acute angle comprises at least 1°.

3. A circular loom as set forth in claim 1, further comprising webs provided between said thread guiding grooves, said webs having wedge-shaped tapered projections at their ends oriented toward the center of a shed.

4. A circular loom as set forth in claim 1, further comprising webs provided between said thread guiding grooves, said webs having a width larger than the width of said thread guiding grooves.

5. A circular loom as set forth in claim 4, wherein the ratio of the width of a web to the width of a thread guiding groove is approximately two to one.

6. A circular loom as set forth in claim 1, wherein said guiding surfaces of said lower and said upper running races are inwardly inclined.

7. A circular loom as set forth in claim 1, wherein said lower and said upper running races are made of synthetic material.

8. A circular loom as set forth in claim 7, wherein said synthetic material is selected from the group consisting of polyoxymethylene and a polyamide.

9. A circular loom as set forth in claim 7, wherein said lower and said upper running races are comprised of injection molded synthetic material.

10. A circular loom as set forth in claim 7, wherein said lower and said upper running races are comprised of transfer molded synthetic material.

11. A circular loom as set forth in claim 7, wherein said lower and said upper running races are comprised of casted synthetic material.

* * * * *